United States Patent [19]

Suzuki et al.

[11] 4,116,568

[45] Sep. 26, 1978

[54] CARRIAGE DRIVING MECHANISM FOR PRINTER

[75] Inventors: Takami Suzuki; Masayuki Suzaki, both of Yokohama; Tomoyuki Moriya, Atsugi, all of Japan

[73] Assignee: Ricoh Co., Ltd., Japan

[21] Appl. No.: 784,373

[22] Filed: Apr. 4, 1977

[30] Foreign Application Priority Data

Apr. 5, 1976 [JP] Japan ..... 51-37294

[51] Int. Cl.[2] ..... B41H 19/30

[52] U.S. Cl. ..... 400/320; 400/322; 400/328

[58] Field of Search ..... 74/10.7, 37, 89.22; 197/60, 66, 82, 89

[56] References Cited

U.S. PATENT DOCUMENTS

| | | | |
|---|---|---|---|
| 2,884,788 | 5/1959 | Clark | 74/10.7 |
| 3,872,960 | 3/1975 | Gabor | 197/82 X |
| 3,951,249 | 4/1976 | Nerbas et al. | 197/82 |

FOREIGN PATENT DOCUMENTS

| | | | |
|---|---|---|---|
| 2,273,666 | 1/1976 | France | 197/82 |

*Primary Examiner*—Paul T. Sewell

*Attorney, Agent, or Firm*—McGlew and Tuttle

[57] ABSTRACT

A driving mechanism for the carriage of a printer, having a motor with a driving pulley thereon, which has attached to it the ends of left and right cables, each of which is folded at its respective center. The folded portions of the cables are wrapped on a pair of pulleys mounted on the carriage.

8 Claims, 3 Drawing Figures

CARRIAGE DRIVING MECHANISM FOR PRINTER

BACKGROUND OF THE INVENTION

The present invention relates to a low or high speed printer with a carriage which carries a printing unit and is moved laterally along a printing paper.

The use of a combination of a pulley and a wire rope has been known as a mechanism for controlling a movement of the carriage to move it laterally along the printing paper at high speed and to stop it exactly at predetermined positions. The driving mechanism of the type mentioned above for converting a rotational movement of a motor into a straight movement of the carriage has many advantages over the conventional system such as a lead screw driving system, a steel belt driving system or a timing belt driving system in that the construction is much simpler, the moment of inertia is very small, the durability and reliability are very high and the accumulation of errors due to a variation of the feeding pitch is relatively small.

There is a known carriage driving mechanism for a printer having a wire rope means, which comprises a pair of wire rope segments of a same length, one end of each segment being attached to a driving pulley and another end fixed to the carriage through a stationary pulley in the frame.

U.S. Pat. No. 3,872,960 discloses a typical example of the pulley and wire rope driving mechanism for a carriage of a high speed printer, in which the carriage carrying a printing wheel is coupled to a driving motor through a pulley which has attached to it each end of left and right wire rope segments of equal length, the other ends of the wire rope segments being attached to the machine frame. The wire rope segments are coupled to the carriage through a pulley arrangement.

In these prior printers, the driving force for driving the carriage is transmitted through the single wire rope and this wire rope has to be stretched under a certain stress in order to prevent the wire rope from being late in moving the carriage due to the elongation of the wire rope and to thereby insure an exact transmission of the driving force of the motor to the carriage. Therefore, the thickness of the wire rope should be large and hence the diameter of the pulley should also be large enough correspondingly for maintaining the resistance to the repeat bending fatigue, resulting in an increase of the movement of inertia.

The above problems inherent to the prior printer, may be resolved by, for example, utilizing a pulley block to reduce the tension force to be exerted on the wire rope and making the diameter of the driving pulley correspondingly larger to take up the wire rope increased in length due to the use of the pulley block mechanism.

In this case, however, since the rotational angle of the motor may be increased in comparison with the system which does not use the pulley block and the inertia of the carriage unit converted on the motor shaft may be increased due to the increase of the diameter of the driving pulley, the tension force exerted on the wire rope is increased in spite of the intended reduction thereof due to the utilization of the pulley block. Therefore, it is very difficult to select an optimum condition between the various elements.

SUMMARY OF THE INVENTION

Primary object of the present invention is to remove the disadvantages of the conventional carriage driving apparatus for a printer.

According to the present invention, in a printer of the type mentioned previously, a wire rope is folded into two segments, each rope being folded at a center thereof to form a pair of parallel rope or cable portions. The open ends of the parallel rope or cable portions are attached to a driving pulley and the connected ends of the rope pairs or the area of the fold in the rope segments are directly wrapped on a pair of pulleys mounted on the carriage, respectively, or are hooked on by pulleys on a frame of the printer, the wire ropes being wrapped around the pulleys on the carriage. It is preferrable to arrange in the area between the driving pulley and the pulleys on the carriage, pulley arrangements with a pair of stacked pulleys movable freely independently of each other.

Other objects and features will become clear by reading the following description of preferred embodiments together with the accompanying drawings.

DESCRIPTION OF THE PREFERRED EMBODIMENTS

Figure 1:
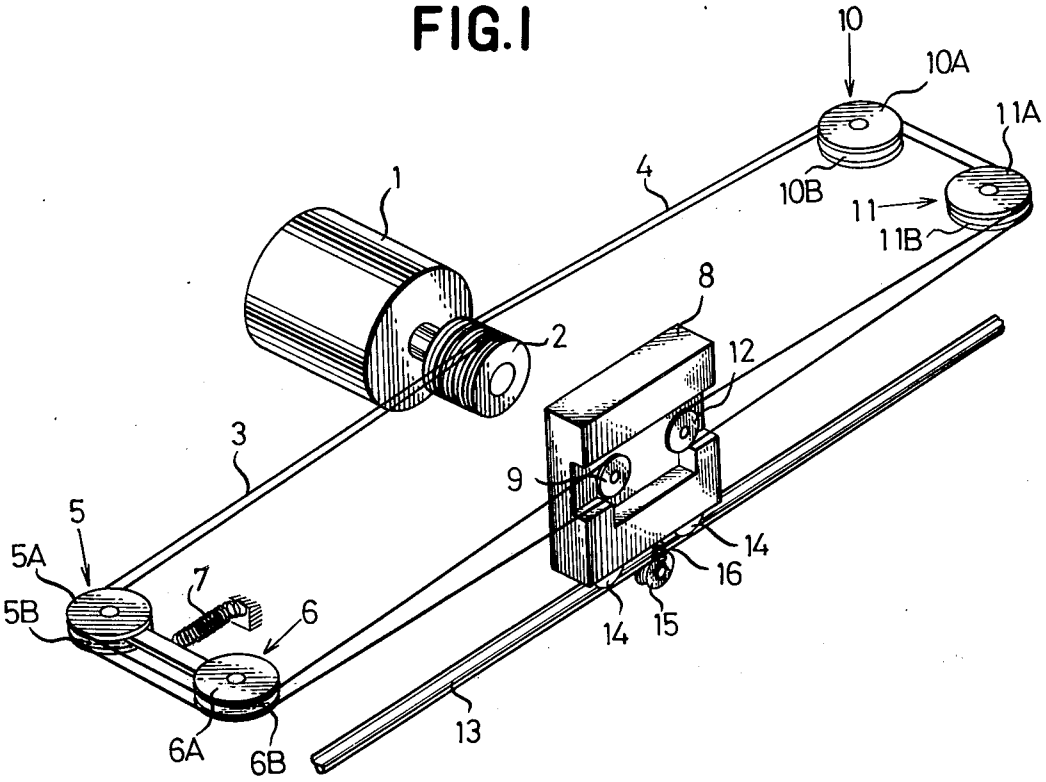
FIG. 1 is a perspective view of an embodiment of the carriage driving mechanism according to the present invention.

In FIG. 1, on an output shaft of a driving motor 1, a pulley 2 is fixed. Both ends of a pair of cables 3 and 4 substantially equal length are attached to the pulley 2. Each of the cables 3 and 4 is composed of a single wire rope folded at a center portion thereof to form a pair of parallel ropes each having its free end connected to the free end of the other. The open or free ends of the parallel ropes constituting, for example, the cable 3 correspond to the end of the cable attached to the driving pulley 2.

Figure 2:
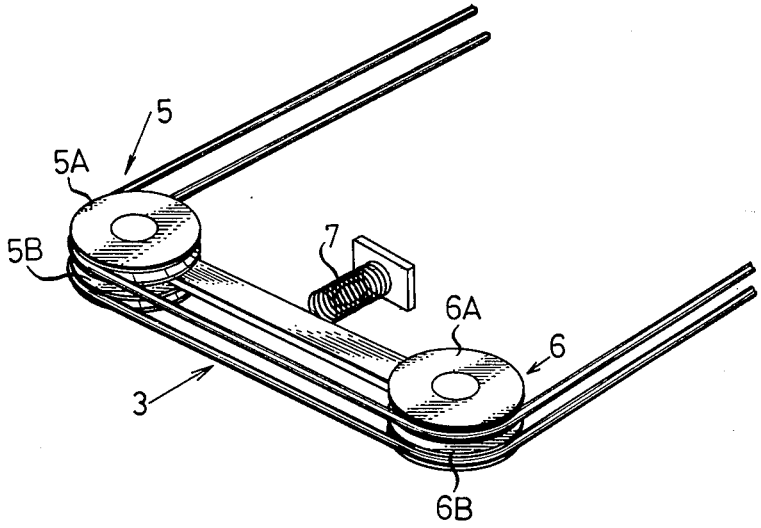
FIG. 2 is an enlarged perspective view of guide pulleys of the driving mechanism in FIG. 1.

The cable 3 extends over and is guided by guide pulley means comprising idler pulleys 5 and 6 mounted on a frame of the printer through a compression 7 and the other end of the cable corresponding to the connected end portions of the parallel wire ropes is hooked on by a carriage pulley 9 mounted on a carriage 8 carrying a printing unit (not shown). The idler pulley 5 is constituted with a pair of stacked guide rollers 5A and 5B rotatable independently of each other and the idler pulley 6 is also constituted with a pair of stacked guide rollers 6A and 6B rotatable independently of each other as shown in FIG. 2.

The cable 4 extends over idler pulleys 10 and 11 mounted on the printer frame and the connected end portion of the parallel wire ropes constituting the cable 4 is hooked on by a pulley 12 mounted on the carriage unit 8. The idler pulley 10 is constituted with a pair of guide rollers 10A and 10B stacked rotatably independently of each other and the idler pulley 11 is constituted with a pair of guide rollers 11A and 11B stacked rotatably independently of each other.

The carriage 8 is provided with a pair of roller wheels 14 riding on a guide rod 13 and guided along the rod 13 according to the driving force provided by the cables. In order to assure a smooth guiding of the carriage unit 8, a roller 15 is suitably provided in an opposing relation to the roller wheels 14 to pinch the guide rod 13 therebetween. A spring 16 is provided between the roller 15 and the carriage.

As mentioned hereinbefore, since in the present invention, each of the cables 3 and 4 are composed of the pair of parallel wire ropes prepared by folding the single wire rope at the center thereof and since the open ends of the parallel wire ropes are attached to the driving pulley and the connected ends of the parallel wire ropes are turned around the pulley mounted on the carriage unit, the tension force exerted on the parallel wire ropes is distributed uniformly due to a rotation of the pulley on the carriage unit. In this case, since each of the idler pulleys 5, 6, 10 and 11 is constituted with the pair of rollers which are rotatable independently of each other, the uniformity of the tension distribution on the parallel wire ropes is further improved.

Although the constructions of the pulleys 5, 6, 10 and 11 as mentioned above are preferrable, it may be possible to employ, instead of the stacked double structure, a single solid pulley structure adapted to receive the respective wire ropes in parallel, when some slippages of the wire ropes with respect to the grooves of the pulley are taken into consideration.

Figure 3:
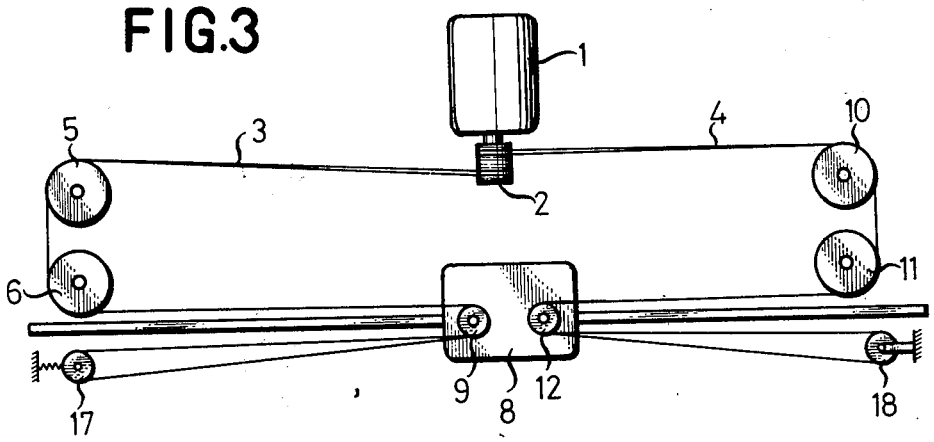
FIG. 3 is a plan view of another embodiment of the present invention.

In another embodiment shown in FIG. 3, the cables 3 and 4 are merely guided by the pulleys 9 and 12 mounted on the carriage unit 8 and the folding portions of the cables are supported by pulleys 17 and 18 mounted on the printer frame, respectively. In this case, it is also preferrable to constitute each of the pulleys 9 and 12 with a pair of rollers rotatable independently of each other. However, taking some slippages of the cables on these pulleys into consideration, it may also be possible to use a single pulley as each of the pulleys 9 and 12.

Since, in the present invention, a load to be owed by each of the wire ropes is a half of that owed by the cable, the duration of the wire rope is prolonged and thus it is possible to make the diameter of the wire rope and hence the diameter of the driving pulley smaller, resulting in a reduction of the inertia of the movable parts of the driving mechanism.

In summary, and referring once more to FIG. 1, a first cable 3 has both of its free ends connected to the drive pulley 2 and is wrapped around a carriage pulley 9 at the approximate midpoint of the cable 3. A similar structure obtains for the second cable 4 which has both ends connected to the drive pulley 2 and is wrapped about the carriage pulley 12 at its approximate midpoint. The advantageous functioning of this structure is realized in that the pulleys 9 and 12 give an additional degree of freedom to the cables 3 and 4, respectively, to insure a continually taut system and a quick response of the carriage 8 when the motor 1 is activated. It should be noted that the pulleys 9 and 12 in FIG. 1 do not rotate greatly when the drive pulley 2 is activated in either the forward or reverse direction. The primary function of pulleys 9 and 12 in FIG. 1 are to take up any differences in length or tension on the two segments of either cable 3 or 4 and therefore function in a more flexible and smooth manner than if the cables were merely rigidly attached to the carriage 8.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

What we claim is:

1. A carriage driving mechanism for a printer comprising: a driver motor, a drive pulley on said driver motor rotatable by said driver motor, at least one cable having two end portions connected adjacent each other to said drive pulley such that both end portions are wound or unwound simultaneously, said cable being folded near its center to form substantially equal and parallel first and second cable portions, at least one carriage pulley rotatably mounted on the carriage having the cable fold wrapped therearound so that the tension on said first and second cable portions due to the driving of said drive pulley are at all times equal.

2. A carriage driving mechanism for a printer, comprising a carriage for moving a printing unit along a predetermined printing stroke with respect to a recording medium, a driving motor for driving said carriage, a drive pulley adapted to be driven by said driving motor and a wire rope means for connecting said drive pulley to said carriage, said wire rope means comprising a pair of wire rope segments, each of said segments being folded at a center portion thereof to form a pair of parallel wire ropes each having one of its ends connected together at the folded portion, and each parallel wire rope having an opposite end attached to said drive pulley such that both opposite ends are wound or unwound simultaneously, said carriage including two independently rotatable pulleys, the folded portion of each of said parallel wire rope pairs being wrapped on each one of said two pulleys, respectively.

3. A carriage driving mechanism as claimed in claim 2, further characterized by guide pulleys mounted on a frame of the printer, said wire ropes being wrapped around the pulleys on the carriage and hooked on by said guide pulleys on the printer frame.

4. A carriage driving mechanism as claimed in claim 2, further comprising by at least one guiding pulley disposed between said driving pulley and said pulleys mounted on said carriage, to form at least one guide for said wire rope pairs, said guiding pulley being composed of a pair of guide rollers rotatable independently of each other.

5. A carriage driving mechanism as claimed in claim 3, further characterized by at least one guiding pulley disposed between said driving pulley and said pulleys mounted on said carriage, to form at least one guide for said wire rope pairs, said guiding pulley being composed of a pair of guide rollers rotatable independently of each other.

6. A drive mechanism for a printer carriage, comprising first and second carriage pulleys mounted on said carriage at spaced locations for rotation about respective first and second axes, a drive motor having a rotatable drive pulley for rotation about a respective third axis parallel to said first and second axes, first and second guide pulley means located beyond respective ends of said carriage mounted for rotation about respective pulley axes substantially perpendicular to said first, second and third axes, a first cable having two ends extending around said first carriage pulley and said first guide pulley means, said two ends being connected to said drive pulley, and a second cable having two ends extending around said second guide pulley means and said second carriage pulley, said two ends being connected to said drive pulley, said first and second cable ends being connected to said drive pulley such that said ends are wound or unwound simultaneously, said first and second cables being wrapped around said carriage pulleys and said carriage being movable by rotation of said drive pulley in one direction to urge said carriage in a first linear direction and being rotatable in an opposite direction to urge said carriage in an opposite linear direction.

7. A drive mechanism for a printer carriage, according to claim 6, including a guide rod defining a carriage track, said carriage having roller wheel means engaged on said guide rod for maintaining said carriage on and in alignment with said guide rod.

8. A drive mechanism according to claim 7, including a counter roller carried by said carriage engaged on the opposite side of said guide rod from said roller wheel means.

* * * * *